US009919834B2

(12) United States Patent
Linares

(10) Patent No.: US 9,919,834 B2
(45) Date of Patent: Mar. 20, 2018

(54) PALLET CONSTRUCTION LINE AND ASSEMBLY

(71) Applicant: Oria Collapsibles, LLC, Auburn Hills, MI (US)

(72) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 673 days.

(21) Appl. No.: 14/592,438

(22) Filed: Jan. 8, 2015

(65) Prior Publication Data

US 2015/0191274 A1 Jul. 9, 2015

Related U.S. Application Data

(60) Provisional application No. 61/925,591, filed on Jan. 9, 2014.

(51) Int. Cl.
*B65D 19/00* (2006.01)
*B31D 5/00* (2017.01)
(Continued)

(52) U.S. Cl.
CPC ..... *B65D 19/0016* (2013.01); *B26D 1/385* (2013.01); *B26D 7/015* (2013.01);
(Continued)

(58) Field of Classification Search
CPC ..... B65D 19/0016; B65D 19/0028; B65D 2519/00825; B65D 2519/0083;
(Continued)

(56) References Cited

U.S. PATENT DOCUMENTS 928,423 A * 7/1909 Belson ..... B65D 5/2028 229/115
1,777,285 A * 10/1930 Adsit ..... B26D 7/2614 493/471
(Continued)

FOREIGN PATENT DOCUMENTS

DE 102007054689 A1 5/2009
EP 183140 A2 6/1986
(Continued)

OTHER PUBLICATIONS

International Search Report and Written Opinion for PCT/US2015/010722, International Filing Date: Jan. 9, 2015, 11 pages.

*Primary Examiner* — Hemant M Desai
*Assistant Examiner* — Mobeen Ahmed
(74) *Attorney, Agent, or Firm* — Dinsmore & Shohl LLP

(57) ABSTRACT

An assembly and associated method for constructing a three dimensional article, such as a pallet, including a first station for feeding a sheet material in blank form, a second a second station for receiving and incising the blank, a third station for receiving the incised blank and which successively creases and folds the blank into an assembled article, and a fourth operator station for controlling each of said first, second and third stations. Also disclosed is a conveyor for removing the assembled article from the third station and transferring to a plastic coating operation.

12 Claims, 14 Drawing Sheets

(51) Int. Cl.

| | |
|---|---|
| ***B31F 1/00*** | (2006.01) |
| ***B31B 50/52*** | (2017.01) |
| ***B31B 50/00*** | (2017.01) |
| ***B26D 1/38*** | (2006.01) |
| ***B26D 7/01*** | (2006.01) |
| ***B26F 1/38*** | (2006.01) |
| ***B31B 50/20*** | (2017.01) |
| ***B31B 50/73*** | (2017.01) |

(52) U.S. Cl.

CPC ..... *B26F 1/384* (2013.01); *B31B 50/006* (2017.08); *B31B 50/20* (2017.08); *B31B 50/52* (2017.08); *B31B 50/734* (2017.08); *B31D 5/00* (2013.01); *B31D 5/0086* (2013.01); *B31F 1/0012* (2013.01); *B65D 19/0028* (2013.01); *B65D 2519/00019* (2013.01); *B65D 2519/00054* (2013.01); *B65D 2519/0083* (2013.01); *B65D 2519/00124* (2013.01); *B65D 2519/00268* (2013.01); *B65D 2519/00273* (2013.01); *B65D 2519/00288* (2013.01); *B65D 2519/00293* (2013.01); *B65D 2519/00303* (2013.01); *B65D 2519/00318* (2013.01); *B65D 2519/00323* (2013.01); *B65D 2519/00333* (2013.01); *B65D 2519/00338* (2013.01); *B65D 2519/00437* (2013.01); *B65D 2519/00442* (2013.01); *B65D 2519/00562* (2013.01); *B65D 2519/00825* (2013.01)

(58) Field of Classification Search

CPC ..... B65D 2519/00562; B65D 2519/00442; B65D 2519/00338; B65D 2519/00333; B65D 2519/00323; B65D 2519/00303; B65D 2519/00293; B65D 2519/00273; B65D 2519/00124; B65D 2519/00318; B65D 2519/00268; B65D 2519/00054; B65D 2519/00019; B65D 2519/00288; B65D 2519/00437; B31B 50/006; B31B 50/005; B31B 50/146; B31B 50/52; B31F 1/0012; B31D 5/0086; B31D 5/00

USPC ..... 493/405, 409, 395, 396, 397, 456, 465, 493/467, 480

See application file for complete search history.

(56) References Cited

U.S. PATENT DOCUMENTS 2,653,708 A * 9/1953 Spalding ..... B65D 5/5038 206/446
2,728,545 A * 12/1955 Hermitage ..... B65D 19/0012 108/51.3
2,976,779 A * 3/1961 Hamilton ..... B27F 7/15 29/241
3,235,432 A * 2/1966 George ..... B31F 1/2895 156/201
3,373,663 A * 3/1968 Heim ..... B31B 50/00 493/164
3,434,435 A * 3/1969 Achermann ..... B65D 19/0026 108/51.3
3,464,371 A 9/1969 Gifford
3,559,866 A * 2/1971 Olson, Sr. ..... B65D 5/504 206/454
3,648,557 A * 3/1972 Lind ..... B26D 1/205 83/489
3,766,816 A * 10/1973 Loveless ..... B23D 19/02 83/478
3,795,394 A * 3/1974 Walker ..... B65B 63/04 493/413
3,913,464 A * 10/1975 Flaum ..... B31B 50/00 493/142
3,978,773 A * 9/1976 Pinto ..... B65B 61/207 493/438
4,200,032 A * 4/1980 Roda ..... B31B 50/00 493/451
4,305,716 A 12/1981 Nickum
4,563,377 A * 1/1986 Melli ..... B65D 19/0095 108/51.3
5,184,558 A 2/1993 Wozniacki
5,207,631 A * 5/1993 Schmidtke ..... B31D 5/00 108/51.3
5,339,746 A * 8/1994 Vannatta ..... B65D 19/0012 108/51.3
5,372,570 A 12/1994 Schmidtke et al.
5,423,270 A * 6/1995 Kilpatrick ..... B65D 19/0012 108/51.3
5,503,085 A * 4/1996 Rozek ..... B65D 19/0087 108/51.3
5,528,994 A 6/1996 Iseli
5,533,954 A * 7/1996 Zogg ..... B65D 5/48042 493/310
5,813,965 A * 9/1998 Mitchell ..... B31B 5/80 271/95
5,836,254 A * 11/1998 Johansson ..... B65D 19/0026 108/51.3
5,844,807 A 12/1998 Anderson et al.
6,019,226 A 2/2000 Zajdlik et al.
6,159,137 A * 12/2000 Lee ..... B26D 7/2621 493/151
6,539,880 B2 * 4/2003 Simms ..... B65D 19/0012 108/51.3
6,718,888 B2 4/2004 Muirhead
6,944,928 B1 * 9/2005 Johansson ..... B31D 5/04 29/430
7,828,708 B2 * 11/2010 Huang ..... B65B 43/265 493/124
8,182,406 B2 * 5/2012 Reuteler ..... B65B 7/20 493/126
8,813,660 B2 8/2014 Linares
2004/0202531 A1 * 10/2004 Beransky ..... B23K 26/083 414/331.18
2005/0039588 A1 * 2/2005 Chieng ..... B26D 1/205 83/485
2005/0247240 A1 * 11/2005 Nelson ..... B65D 19/0012 108/51.3
2006/0156886 A1 * 7/2006 Suzuki ..... B26D 7/015 83/485
2006/0207905 A1 9/2006 Whiteside
2006/0260455 A1 * 11/2006 Yeghiayan ..... B26D 1/185 83/455
2007/0000857 A1 1/2007 Roth
2007/0028814 A1 2/2007 Swistak et al.
2007/0066474 A1 * 3/2007 Jenkins ..... B31D 5/00 493/463
2007/0108090 A1 5/2007 Whiteside et al.
2007/0125211 A1 * 6/2007 Hilgendorf ..... B26D 1/157 83/213
2007/0162174 A1 * 7/2007 Doke ..... B25J 9/0093 700/117
2007/0235363 A1 10/2007 Whiteside et al.
2009/0246461 A1 10/2009 Linares
2010/0043678 A1 * 2/2010 Linares ..... B32B 3/12 108/57.25
2010/0210436 A1 * 8/2010 Taketsugu ..... B65H 29/62 493/29
2010/0288142 A1 * 11/2010 Sugimoto ..... B41F 5/24 101/216
2011/0052814 A1 * 3/2011 Hatano ..... B05C 5/0275 427/256
2011/0092351 A1 * 4/2011 Hatano ..... B31B 50/00 493/162
2011/0303128 A1 12/2011 Linares
2012/0115698 A1 * 5/2012 Vizanova Alzamora . B31B 3/00 493/126
2012/0260832 A1 10/2012 Linares

(56) References Cited

U.S. PATENT DOCUMENTS

| | | | | |
|---|---|---|---|---|
| 2013/0112117 | A1* | 5/2013 | Casey | B65D 19/0012 108/51.3 |
| 2013/0157832 | A1* | 6/2013 | Erdie | B31F 1/0009 493/405 |
| 2015/0191275 | A1* | 7/2015 | Linares | B65D 19/004 108/57.29 |

FOREIGN PATENT DOCUMENTS

| | | | |
|---|---|---|---|
| EP | 774341 | A2 | 5/1997 |
| EP | 1227986 | A1 | 8/2002 |
| WO | 9852829 | A1 | 11/1998 |
| WO | 2006000657 | A1 | 1/2006 |
| WO | 2006011728 | A1 | 2/2006 |
| WO | 2007134481 | A1 | 11/2007 |

* cited by examiner

PALLET CONSTRUCTION LINE AND ASSEMBLY

CROSS-REFERENCE TO RELATED APPLICATIONS

This Application claims the benefit of U.S. Provisional Application 61/925,591 filed on Jan. 9, 2014, the contents of which is incorporated in its entirety.

FIELD OF THE INVENTION

The present invention relates generally to an assembly line and process for constructing a pallet and, more particularly, to a multi-station assembly for successively cutting, bending, assembling (via inter-engaging tab and slot or other configurations) and coating a pallet. The invention also discloses a one piece assembled pallet produced by the assembly and process and which exhibits superior structural integrity as compared to previous multi-piece pallets which are assembled with the use of adhesives and the like.

BACKGROUND OF THE INVENTION

The prior art is documented with examples of packaging and other articles which can be assembled into a three dimensional article. A first example of this is set forth in Schmidtke, U.S. Pat. No. 5,207,631 which teaches a method and apparatus for folding of sheet material into symmetrical and nonsymmetrical shapes, such as applied to making a pallet construction. A series of symmetrical stringer members are inserted into an equal plurality of non-symmetrically shaped cross-stringers, both of which have had adhesive applied while being folded to retain the shape into which they are made. A top sheet is applied and also glued in place to make the pallet.

A corresponding method includes supplying a sheet of material such as a fiberboard blank of appropriate composition and size, running the blank through crushing and scoring rollers to produce fold lines in the blank, and asymmetrically (making more folds from one side of the blank than from the other side) or symmetrically folding the blank into a predetermined shape while applying adhesive at predetermined points. The blank is folded by passing it through a multi-function folding means, including a lifting means which can slightly lift the outside edge of the blank until a belt-like folding and propelling means can then fold one panel of a blank over onto the other panel while adhesive is being applied. The folding operation can be repeated as many times as is needed to form the part.

Zadjik, U.S. Pat. No. 6,019,226, teaches a multi-component demountable palletized container including a pallet bottom, four sidewall components which may be readily assembled with rods and disassembled, and a top. Each of the sidewalls include a pair of horizontal and a pair of vertical members that are overlapped at their ends and are secured together. An inner cardboard panel is secured to the inside of the sidewalls and closes off the space between the members. The vertical members define grooves or channels which receive assembly straps or clips having hooked ends which align to define a corner axis and which receive elongate rods.

EP 0 774 341 teaches a pallet lay-up system which utilizes a method in which spool-shaped paper supports wound with integral end flanges are processed in sequential linear arrays for adhesive attachment to first and second corrugated paperboard deck sheets applied in separate lay-up stations.

The method further teaches modifications for the manufacture of a variety of pallet and pallet-like structures which include partial deck sheets, multi-layer deck sheets and the like.

WO 98/52829 teaches a pallet constructed of a flat blank of material formed of corrugated cardboard or plastics material. The blank forms, when assembled, a structural element including a number of wall forming panels delimited by a set of transverse fold lines and having at least two flaps which provide a diagonal cross brace. The structural element may be formed as a separate component or as an integral part of a larger structure such as a pallet or box.

WO 2007/134481 discloses an assembled paper pallet including paper grooves and cores made of paperboard. The grooves are "U" shaped and holes for expansion are provided in joints of the grooves and cores.

SUMMARY OF THE INVENTION

The present invention discloses an assembly for constructing a three dimensional article, such as a pallet, and including a first station for feeding a sheet material in blank form, a second a second station for receiving and incising the blank, a third station for receiving the incised blank and which successively creases and folds the blank into an assembled article, and a fourth operator station for controlling each of said first, second and third stations. Also disclosed is a conveyor for removing the assembled article from the third station and transferring to a plastic coating operation.

Other features include the second incising station further including a generally rectangular shaped blank supporting and profiled surface including irregular configured side edges which co-act with an incising pattern formed into a drum shaped roller knife supported over said profiled surface. The drum shaped roller knife is mounted about a rotary axis via support pins with a pair of length traversable side pedestals supporting the drum knife in elevated and top surface adhering fashion with the blank material supported over the support surface pedestals being traversed along tracks or guiding edge profiles, this as the roller knife is rolled across and over the blank with the incising pattern exhibited on the drum synchronized in a progressive contacting fashion with the support surface so that the incising pattern coacts with the irregular edges in order to section an outer frame portion from the blank.

The third station further includes first and second pluralities of elongated rods which are channeled to extend through an equal number of base components secured atop a perimeter extending surface of a platform or table associated with a first creasing operation such that the individual pluralities of the rods extending over and across a pair of spaced apart recessed regions in the platform upon which the incised blank is initially positioned. Each of the recessed regions further exhibits a plurality of inter-angularly configured surfaces.

Additional features include each of the rods further having an underside projecting and fold-line forming blade edge creasing a width extending surface of the previously incised blank so that a plurality of crease lines are configured into the blank. A rectangular shaped reinforced insert placed upon a central surface of the blank corresponds to an eventual base interior of the assembled pallet. Other features include the reinforcing insert further exhibiting any type of honeycombed structure or other structurally reinforcing pattern for lending the eventual pallet construction with additional structural rigidity.

The third station includes opposite side located pluralities of actuating guides which are formed within recessed locations of the perimeter extending surface of the table and which pivot angularly upwardly in order to grasp and fold previously incised edge locations of the blank corresponding with a central support area. Other features associated with the third station also include first and second pluralities of opposite end extending arms configured such that they are pivotally secured at proximal ends to interior locations of said table and further so that they are servo activated or otherwise mechanically controlled to ascend through length extending and spaced apart slots formed in the recessed regions. The pluralities of end supported arms each further include length displaceable gripping portions both pivotally and displaceably associated with each of the elongated arms and which, collectively, configure a plurality of underside support profiles formed from a previously pair of deformed wings or end sections of the blank which are hingedly associated with a reinforced central portion of the blank.

A corresponding method for constructing a three dimensional article includes the steps of feeding a sheet material in blank form, incising the blank in order to create a desired cutout pattern, and successively creasing and folding the incised blank into an assembled article. Other steps include configuring each of tabs and slots in proximate side extending edges of the incised blank. The step of creasing the blank further includes forming first and second wings with multiple fold lines which extend from a central planar portion of the blank. The step of folding the blank into an assembled article further includes inserting the tabs into the slots.

Other steps include placing a reinforcing planar shaped insert upon the central blank portion prior to folding the wings into a three dimensional shaped configuration and connveying the assembled article to a separate coating operation for applying a plasticized layer over the article. Other steps include applying bottom sealing strips for sealing recessed interior defining underside edge profiles associated with a plurality of underside supports created in the assembled article, as well as incorporating a reinforcing honeycomb pattern into the planar shaped insert.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring to FIGS. 1-14, the present invention discloses an assembly line and process for constructing a pallet and, more particularly, to a multi-station assembly for successively cutting, bending, assembling (via inter-engaging tab and slot or other configurations) and finish coating a pallet. The invention also discloses a one piece assembled pallet produced by the assembly and process and which exhibits superior structural integrity as compared to previous multi-piece pallets which are assembled with the use of adhesives and the like.

Figure 1:
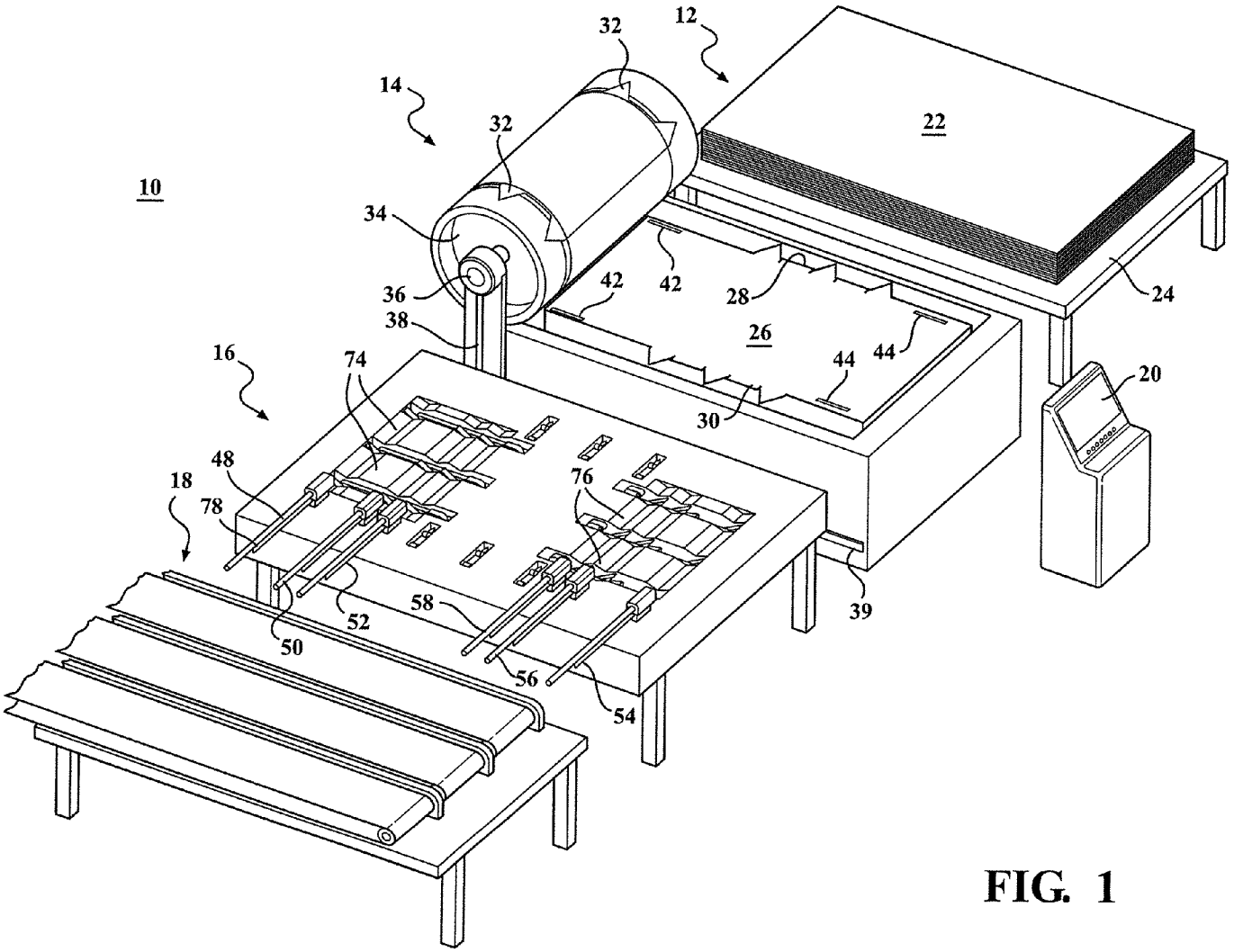
FIG. 1 is an operational assembly view of a plurality of stations including a stacked cardboard blank supporting station, a roller knife supporting and cardboard incising station, a bending/assembling station and a removal station leading to a subsequent spray coating operation according to a non-limiting embodiment.

Referring to FIG. 1, an operational assembly view is generally depicted at 10 of a line assembly incorporating a plurality of stations, such as depicted as including a stacked cardboard blank supporting station 12, a roller knife supporting and cardboard incising station 14, a creasing and bending/three dimensional assembling station 16 and a removal station 18 leading to a subsequent spray coating operation (not shown) according to a non-limiting embodiment. As will be described, the line assembly shown is capable of incising/trimming and assembling/reconfiguring a blank material into a desired three dimensional shape which is not limited to the structurally supporting pallets depicted in the non-limiting embodiment.

Also depicted at 20 in FIG. 1 is an operator station for controlling the rate at which the line assembly operates. Not shown in FIG. 1 are any combination of belts, conveyors or other transfer mechanisms, such as robotic gripping arms, suction generating transfer arms and the like and which facilitate (preferably automated) transfer of the plurality of individual blanks (shown as stacked rectangular shaped pieces of cardboard at 22 initially supported upon a table 24 or other platform) between the various stations prior to delivery to the conveyor removal station 18 for transferring to the subsequent spray coat operation (not shown).

Additional features best depicted in FIG. 1 include a generally rectangular shaped blank supporting and profiled surface 26 at the incising station, this including irregular configured side edges 28 and 30 which co-act with a pair of incising patterns 32 formed into opposite and outwardly facing circumferentially patterns in the outer cylindrical profile surface of a drum shaped roller knife 34. As is understood, the incising pattern corresponds to a cylindrical exterior profile with arcuate configured blade edges or the like which, upon rotating and concurrently translating the roller knife over the supported blank 22 The drum shaped roller knife 34 is in turn mounted about a rotary axis via support pins 36 with a pair of length traversable/displaceable side pedestals 38 supporting the drum 34 in elevated and top surface adhering fashion with a sheet of cardboard blank material 22 supported over the support surface 26 (see FIG. 2).

Upon the side pedestals being traversed across the length of the incising station (FIG. 3), this typically resulting from the pedestals 38 being traversed along tracks or guiding edge profiles (see at 39 defined in the lower opposite side edges of the platform supporting body of the incising station 14), the roller knife 34 is rolled across and over the cardboard sheet 22 with the incising pattern 32 exhibited on the drum 34 synchronized in a progressive contacting fashion with the support surface 26 so that the incising pattern coacts with the irregular edges 28 and 30 in order to section an outer frame portion (see scrap perimeter as shown at 23 in FIG. 3) which falls into an interior cavity (at 40 in FIG. 3) of the incising station 14 prior to automated ejection as shown. At this point, and as again depicted in FIG. 3, the incised cardboard blank (now at 22') exhibits irregular configured edges (see at 45 and 47) which mate with that defined at 28 and 30 in the perimeter support profile of the support surface 26, and as caused to be incised by the traversing roller supported knife 34. Additional elongated and edge proximate incising locations are shown at 42 and 44 in FIG. 1 defined in the blank support surface 26 and which result in cutout slots 46 formed in the blank 22' upon the roller 34 compressing the cardboard blank 22 against the incising locations.

Figure 2:
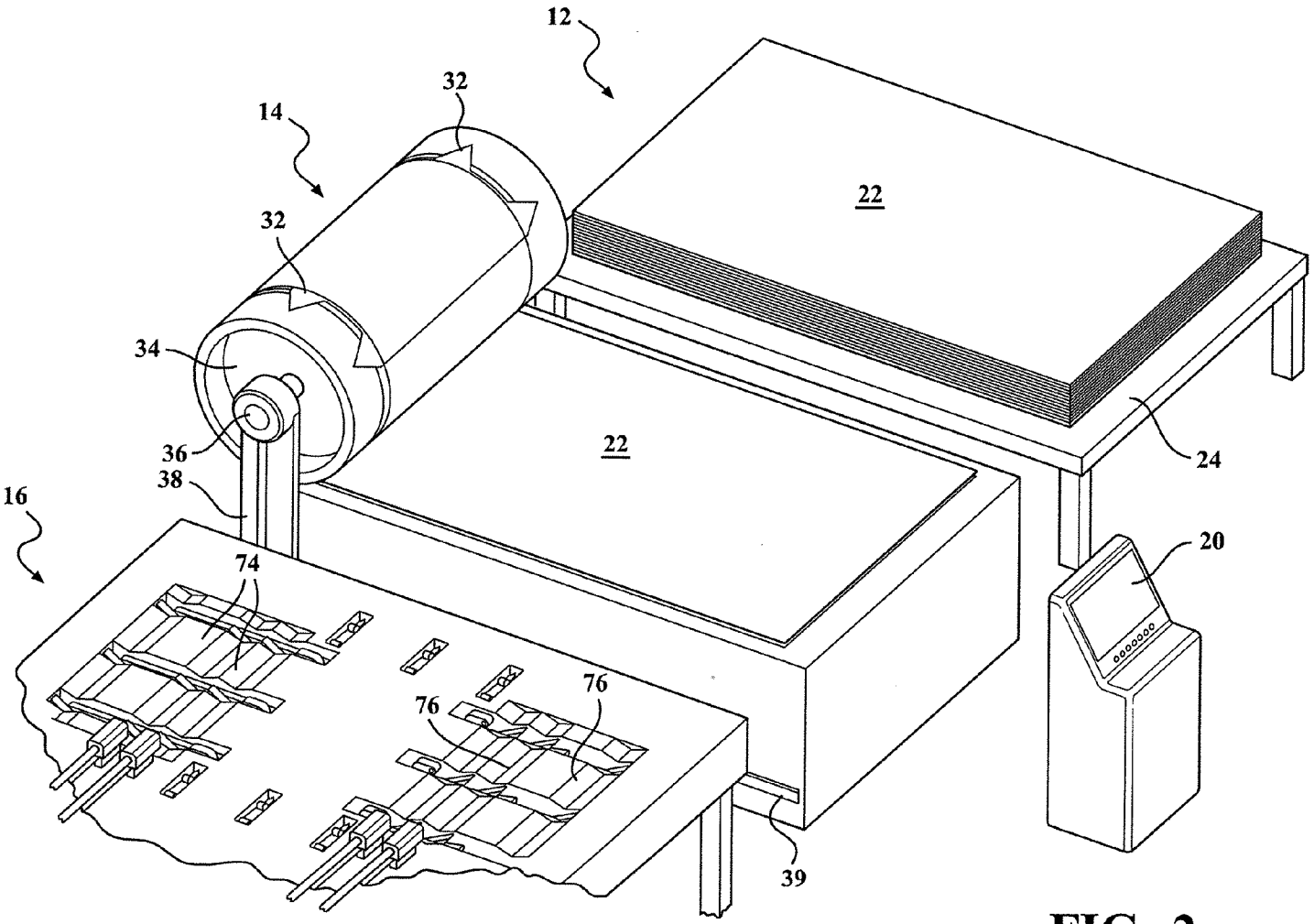
FIG. 2 is an enlarged operational view of the blank supporting, incising and bending/assembling stations and illustrating a first cardboard blank transferred over a generally rectangular perimeter defining support profile with irregular configured edges forming a portion of the incising station, with the roller knife in a pre-actuated position.
Figure 3:
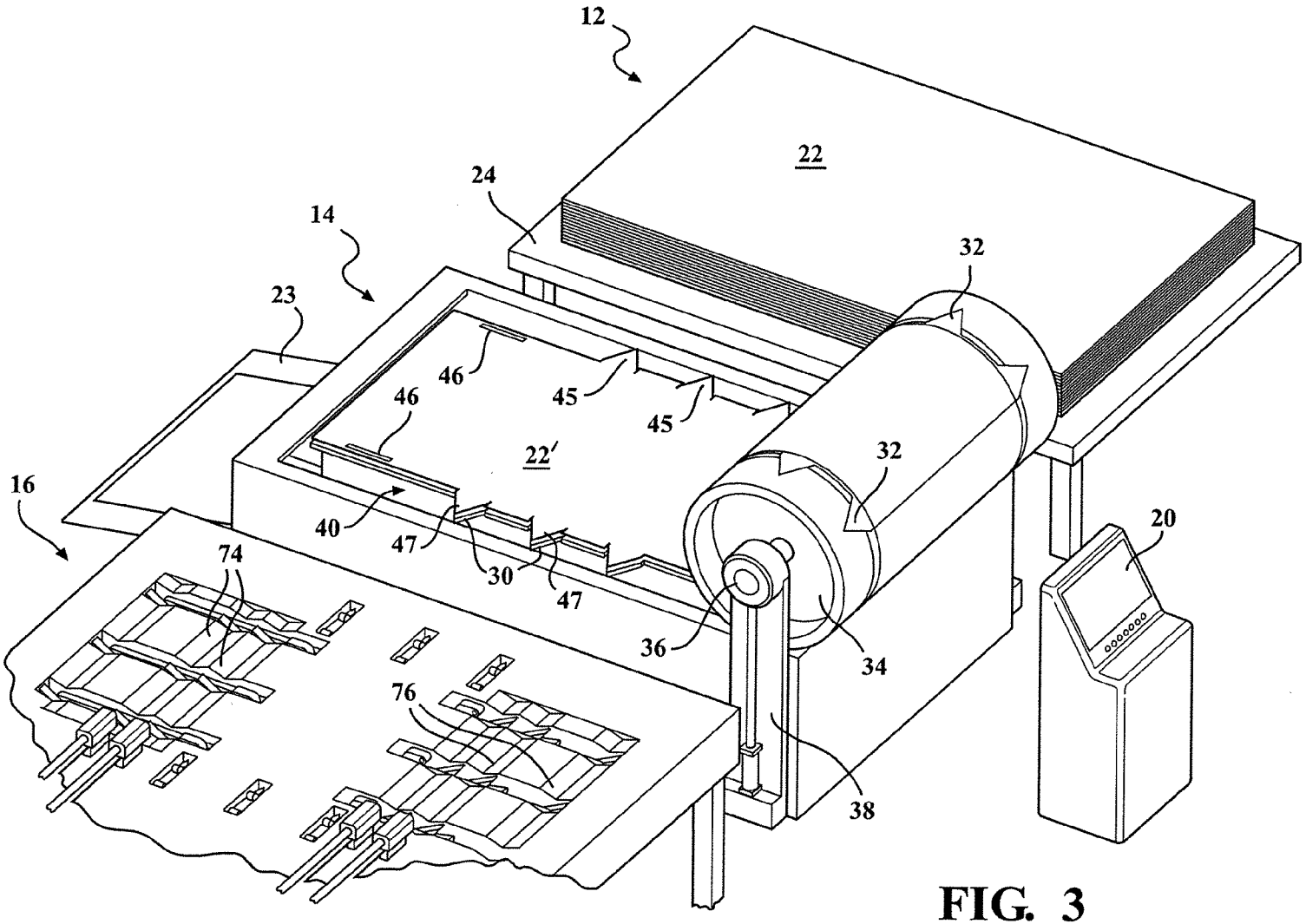
FIG. 3 is a succeeding illustration to FIG. 2 and in which the roller knife is translated across the pre-positioned cardboard blank in order to section edge portions therefrom which overhang the irregular configured edges of the perimeter support profile.
Figure 4:
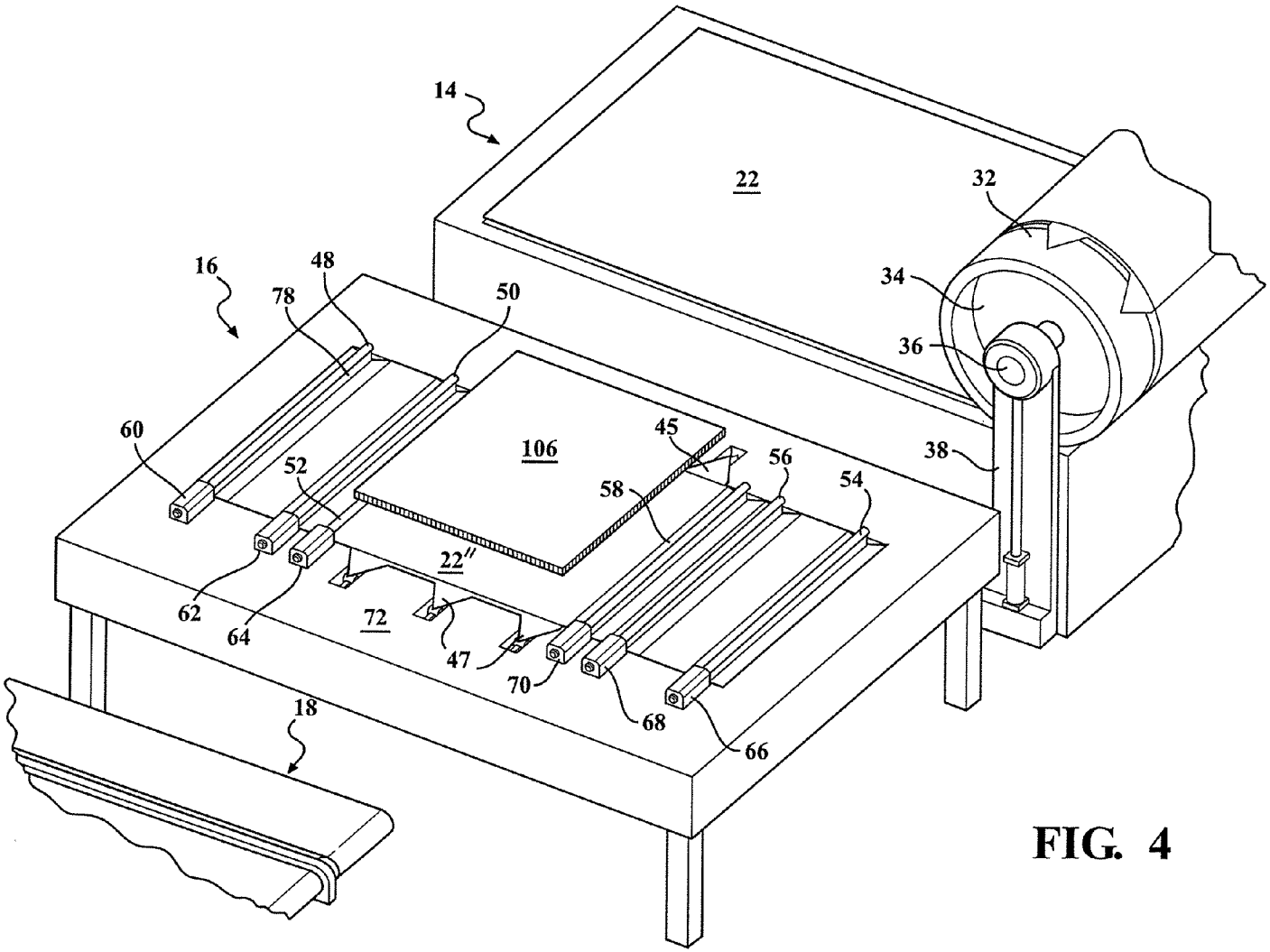
FIG. 4 is a succeeding illustration of the incised blank transferred to the bending/assembly station and illustrating a first creasing operation performed on the incised blank by a plurality of elongated rods extending across a recessed support profile of the bending station, the rods each exhibiting a fold-line forming edge, a rectangular or square shaped reinforced insert subsequently being placed upon a central of the blank corresponding to an eventual base interior of the assembled pallet.

Proceeding to FIG. 4, a succeeding illustration is provided of the incised blank 22' transferred from the incising station 14 to the creasing/bending/assembly station 16, as further shown at 22", and illustrating a first creasing operation performed on the incised blank by first and second pluralities of elongated rods, see at 48, 50 and 52 and further at 54, 56 and 58. As also shown in FIG. 1, the rods are channeled to extend through an equal number of base components 60, 62, 64, 66, 68 and 70 secured atop a perimeter extending upper surface 72 of a platform or table associated with the creasing/bending station and which surrounds a pair of spaced apart regions 74 and 76 each defined by a recessed profile. As best shown in FIGS. 2-3, the regions 74 and 76 are each exhibited by a plurality of irregularly (including angularly) configured surfaces over which the incised insert blank 22" (FIG. 4) is placed and prior to the creasing rods 60-70 being displaced from the laterally extended positions of FIG. 1 to the retracted and operative positions of FIG. 4 in which they extend over the blank 22'.

Each of the rods further exhibits an underside projecting and fold-line forming blade edge (see for example blade edge at 78 projecting along selected rod 48 with each of the additional rods 50, 52, 54, 56 and 58 likewise exhibiting a similar underside configured blade/creasing edge respectively shown), with the blade edge creasing a width extending surface of the previously incised blank in the manner depicted in FIG. 4 and so that a plurality of crease lines 80, 82, 84, 86, 88 and 90 (see FIG. 8) are configured into the blank. Although not shown, additional lateral edge extending and localized crease lines (see at 92, 94, 96 and 98 in FIG. 8) can be formed into opposite side edge locations associated with a planar and base defining middle section 100 of the blank, with the individual pluralities of crease lines 80-84 and 86-90 corresponding to wing sections, generally depicted at 102 and 104, of the blank which are hingedly connected to opposites sides of the middle section 100.

At this stage, a rectangular or square shaped reinforced insert 106 is placed upon the central surface 100 of the blank (see again also FIG. 8), and which corresponds to an eventual base interior of the assembled pallet. The reinforcing insert 106 can include, without limitation, a corrugated paperboard or other like material and can encapsulate or otherwise exhibit any type of honeycombed or other structurally reinforcing pattern for lending the eventual pallet construction with additional structural rigidity. It is also envisioned that a suitable reinforcement, such as provided in a grid shape and including any other suitable material, can be integrated into the insert 106 to further structurally reinforce the assembled pallet.

Figure 5:
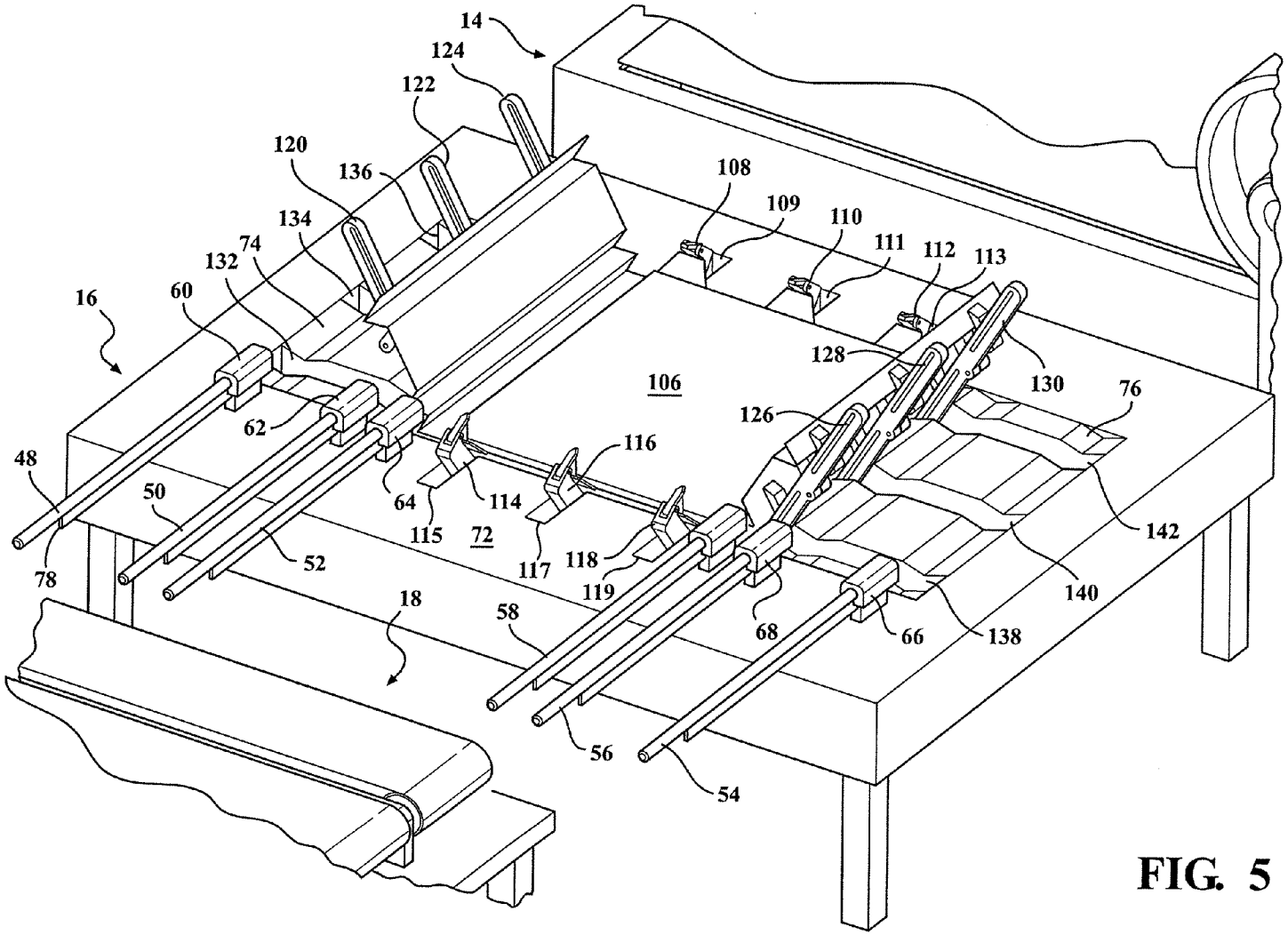
FIG. 5 is a succeeding illustrated stage of the bending/assembly station, in which the elongated rods are retracted from their previous extending positions over the blank and recessed support profile, following which pluralities of side located gripping supports and end extending pluralities of arms actuate in a combined upward angularly and displaceable fashion in an initial bending/pallet forming operation by grasping and manipulating previously incised side edge and width extending fold line locations previously formed into the blank.

FIG. 5 is a succeeding illustrated stage of the creasing/bending and three dimensional assembly station 16, in which the separated pluralities of elongated rods 48-52 and 54-58 are once again retracted laterally outwardly from their previous extending positions over the blank and recessed support profiles (regions 74 and 76). As shown, this includes the channel defined and surface arranged supports 60-64 and 66-70 being pedestal mounted and incrementally elevateable (compare FIG. 5 to FIG. 4) so that the rods and projecting blades disengage from the crease lines 80-84 and 86-90 formed into the blank. At this point, opposite side located pluralities of actuating guides (see at 108, 110 and 112 on a first side and at 114, 116 and 118 on a second side in FIG. 5) which are formed within recessed locations (see inwardly communicated recess profiles 109, 111 and 113 on a first side and additional profiles 115, 117 and 119 on a second side) of the table surface 72 which are in communication with its inner perimeter supporting profile for seating and locating the blank 22" during the creasing and assembling operation. As further shown, the opposing pluralities of actuating guides 108/110/112 and 114/116/118 pivot angularly upwardly in order to grasp and fold the previously incised edge locations 45 and 47 (see also FIG. 4) of the blank 22" supported upon the station 16 and corresponding with the central support area 100.

Concurrent with the lateral edge displacement of the tab forming guides 108-118, additional and opposite end extending pluralities of arms (see at 120, 122 and 124 and further at 126, 128 and 130) are configured such that they are pivotally secured at proximal or base ends to interior locations of the bending table and further so that they are servo activated or otherwise mechanically controlled (such as via additional components known in the art and which are located in communication with an underside of the table surface associated with the station 16) to ascend through length extending and spaced apart slots which are respectively shown at 132, 134 and 136 and at 138, 140 and 142 formed in the recessed regions 74 and 76 of the creasing/incising station 16). As further shown in FIG. 6, the end pivoting arms 120-124 and 126-130 are each supported at base ends to an upper displaceable portion, see further at 144, 146 and 148 for arms 120-124 and further at 150, 152 and 154 for arms 126-130, the base ends constituting pivotal supports which rotate from underside locations of the incising station (see pin location 151 for selected support 152 which mounts to the incising table so that the base supports can rotated upwardly through the various slots 132-136 and 138-142 and from stored/non-use positions to use positions). As further shown, the arms 120-130 can actuate in either a pivotable and/or displaceable fashion relative to the base supporting ends (this is further depicted by selected base end support 144 which illustrates a slot 156 through which a further pin 158 is supported which in turn engages the proximal end of the selected pivoting arm 120.

As initially shown in FIG. 5, the linear extending and end proximate situated sub-pluralities of pivotal/displaceable arms 120-124 and 126-130 initially upwardly fold the extending wing sections (see also at 102 and 104 in FIG. 8) of the blank in the manner shown. This is facilitated by the addition of length displaceable gripping portions both pivotally and displace-ably associated with each of the elongated arms 120-130 and which, collectively, configure a plurality of underside support profiles formed from a previously pair of deformed wings or end sections of the blank which are hingedly associated with the reinforced central portion.

Figure 6:
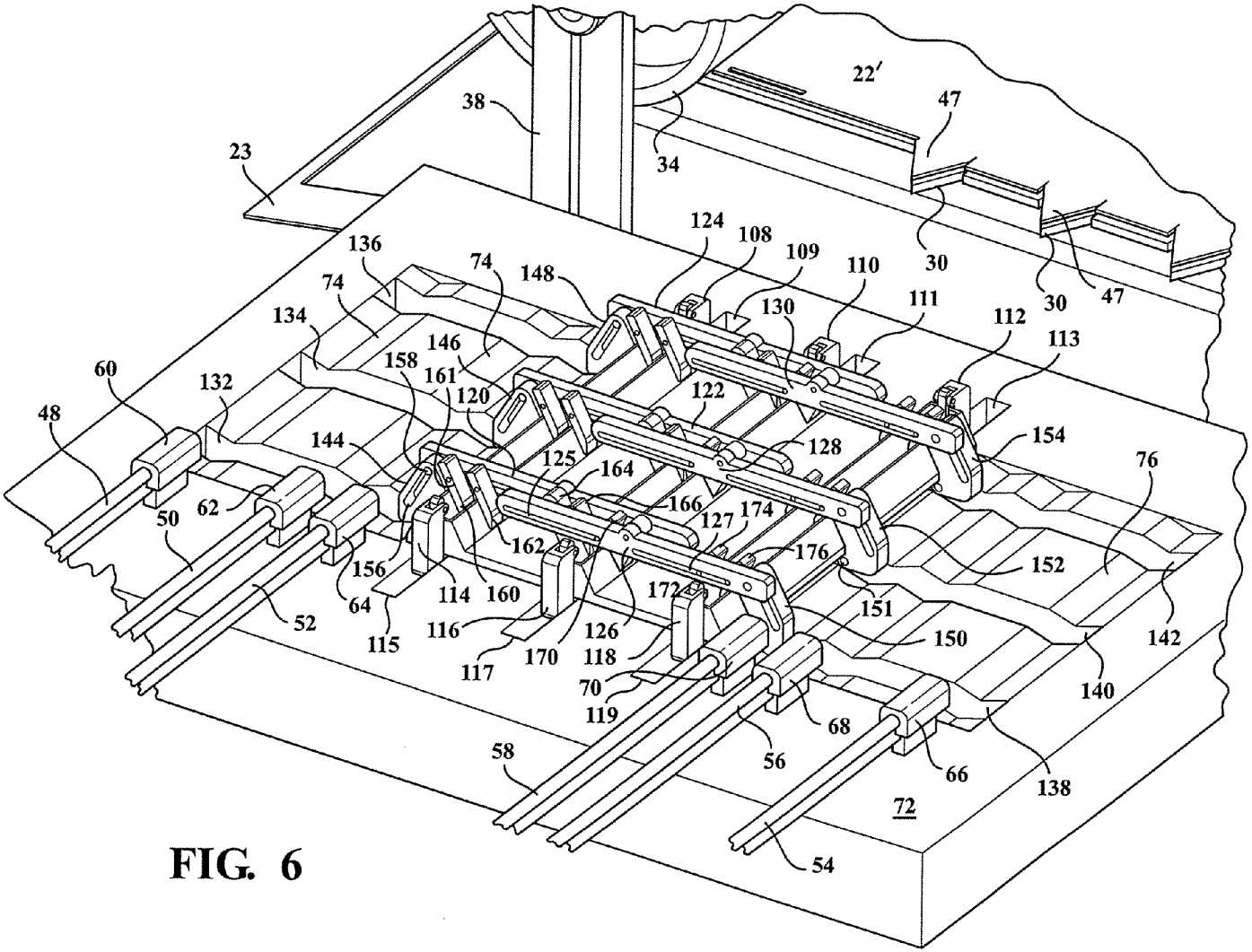
FIG. 6 is a successive bending step to FIG. 5 and in which the side arms and elongated end rotating arms overlay the top surface of the intermediately formed pallet body and in which additional length displaceable gripping portions associated with the elongated arms configure a plurality of underside support profiles formed from a previously pair of deformed wings or end sections of the blank which are hingedly associated with the reinforced central portion.

For purposes of ease of illustration, the arm supported gripping portions are best depicted in FIG. 6 and include by simplified designation an individual plurality of gripping portions 160, 162, 164 and 166 associated with arm 120, with additional gripping portions 170, 172, 174 and 176 associated with opposite end located and closely overlapping arm 126. Additional and closely overlapping pairs of arms 122/128 and 124/130 are also shown in the arrangement of FIG. 6 with similar pluralities of individually actuating gripping portions (also both pivotally and displaceably supported along their respective arms), these not being separately identified for purposes of ease and clarity of illustration.

As again shown in FIG. 5, the end displaceable pluralities of arms actuate in upwardly and angularly coordinating fashion in an initial bending/pallet forming operation by grasping and manipulating previously incised side edge (again at 45 and 47) and width extending fold line locations (again at 80-90) previously formed into the blank. As further provided for in FIG. 6, a successive bending step is employed in which the side extending guides 108-112 and 114-118 and elongated end pivoting/displacing arms 120-124 and 126-130 overlay the top surface of the intermediately formed pallet body and in which the additional sub-pluralities of length displaceable gripping portions associated with the elongated arms configure a plurality of underside support profiles formed from a previously pair of deformed wings or end sections 102 and 104 of the blank which are hingedly associated with the reinforced central portion 100.

As further shown in FIG. 6, the individual plurality of gripping portions 160, 162, 164 and 166 associated with the arm 120 and the additional gripping portions 170, 172, 174 and 176 associated with the opposite end located and closely overlapping arm 126 each further exhibit a relatively thin and elongated forming body with a narrowing bottom edge (see in particular for selected gripping portions 160 and 162). Each of the gripping portions is further pivotally supported by a further pin (see at 161 for selected gripping portion 160) which seats within an inner elongated slot associated with each overlapping arm (a further example of this best shown by selected slots 125 and 127 for elongated arm 126). The final assembly protocol at station 16 contemplates the pivotal gripping portions being either stationary or displaceable along the relative slots defined in their associated elongated arms, and such as which is necessary in order to provide the desirable support surfaces for completing the three dimensional assembly of the finished article.

Figure 7:
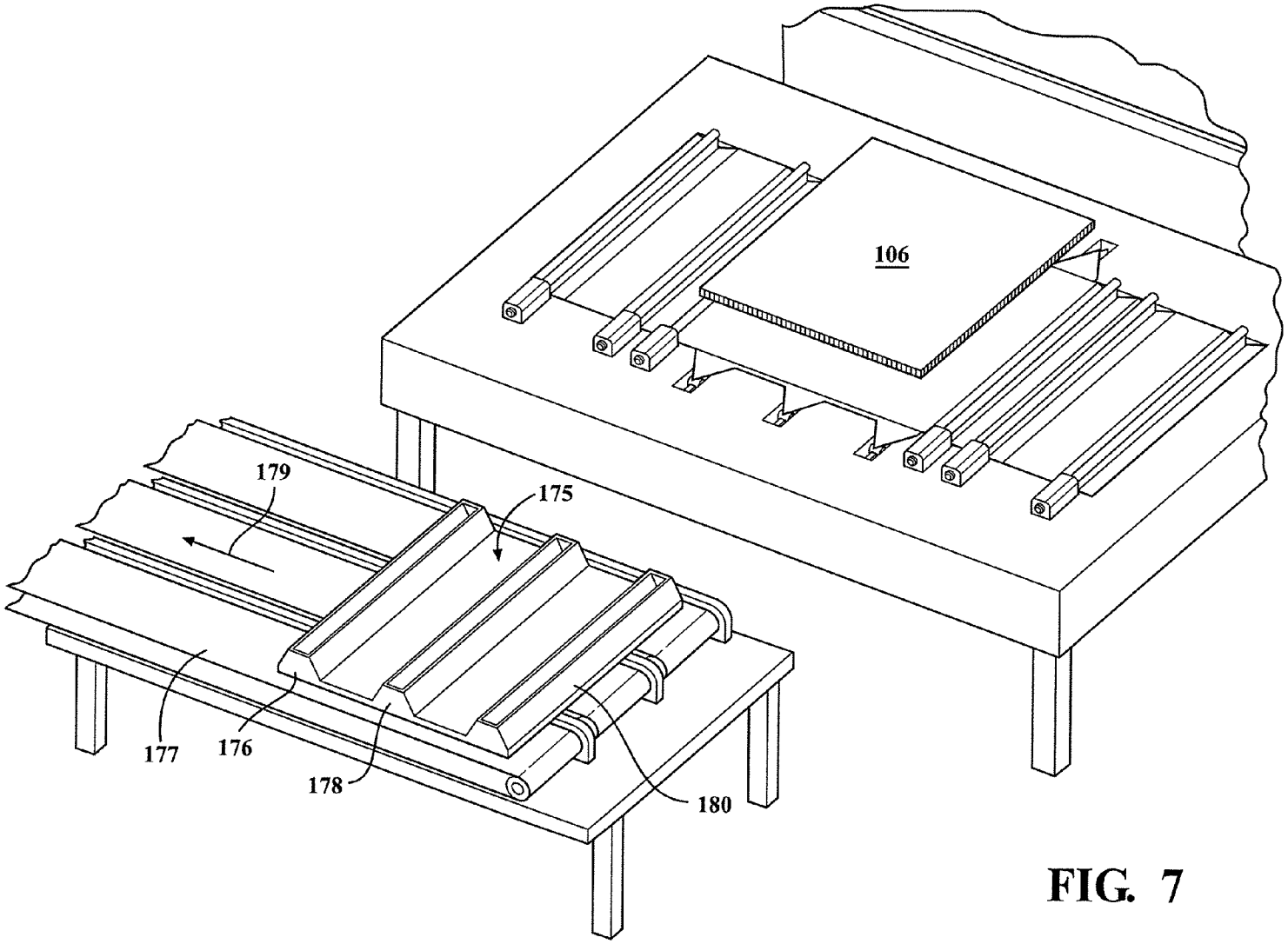
FIG. 7 is a succeeding illustration to FIG. 6 and in which a successive loading operation of an incised blank onto the bending station is depicted in similar fashion to FIG. 4, concurrent with a previously assembled and three dimensional pallet produced according to the afore-described bending protocol being transferred via the removal station to a subsequent spray coating operation.
Figure 8:
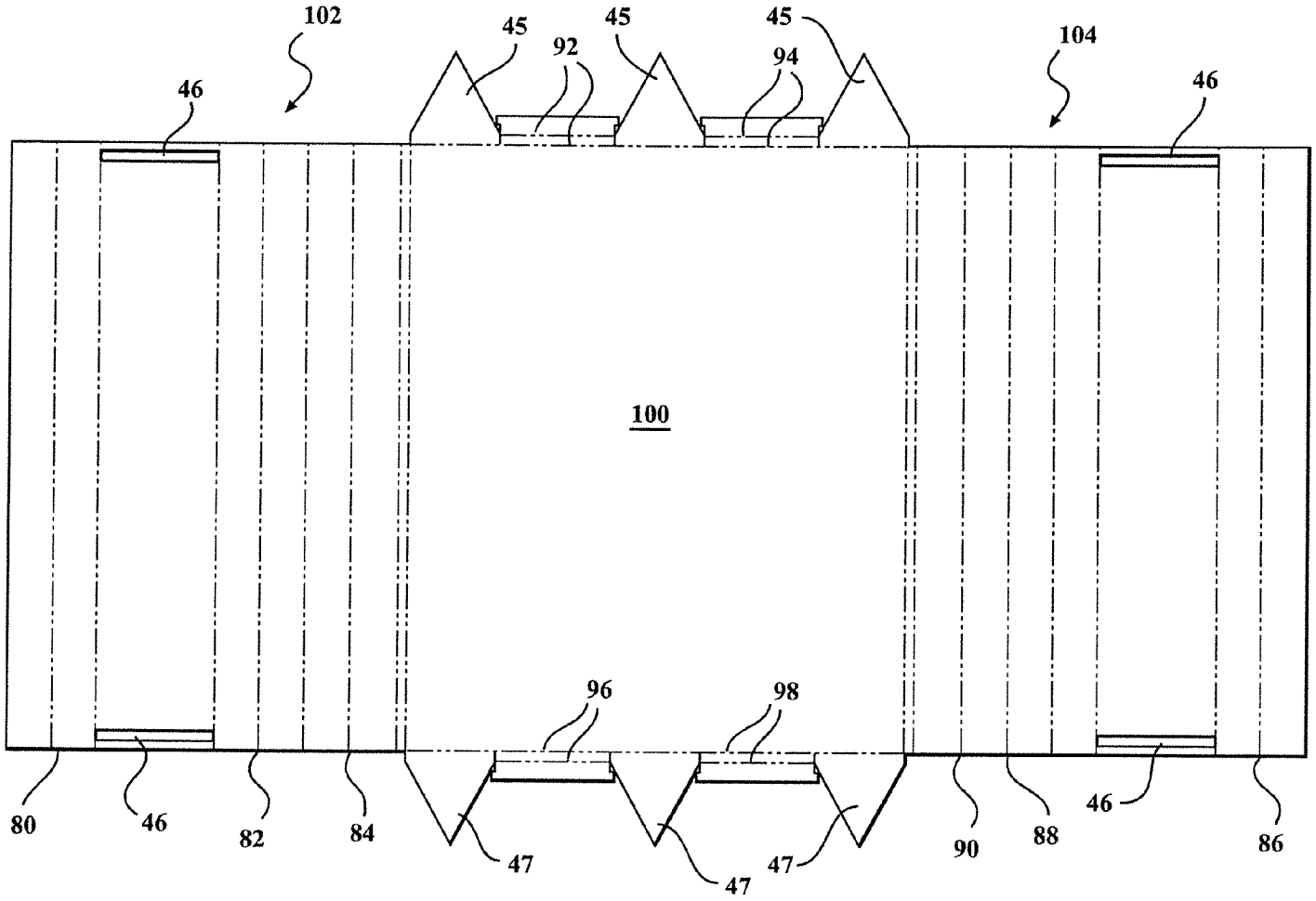
FIG. 8 is an enlarged plan view illustration of an incised and initially creased blank as shown in FIG. 3.

Although not clearly shown, the arrangement of tabs (at 92-98) and slots 46 are such that the wings 102 and 104 of the pallet are folded and assembled around the reinforcing insert 106 in the manner shown in FIGS. 6 and 7 so as to create a one-piece and structurally supporting article. The inter-folded configuration of the assembled pallet, generally depicted at 175 in the conveyor transferred location of FIG. 7 as well as in individual fashion in FIG. 9, further complements the incised edge locations 45 and 47 of the central section which define overlapping end flaps for closing off the individual and underside support profiles shown at 176, 178 and 180.

Figure 11:
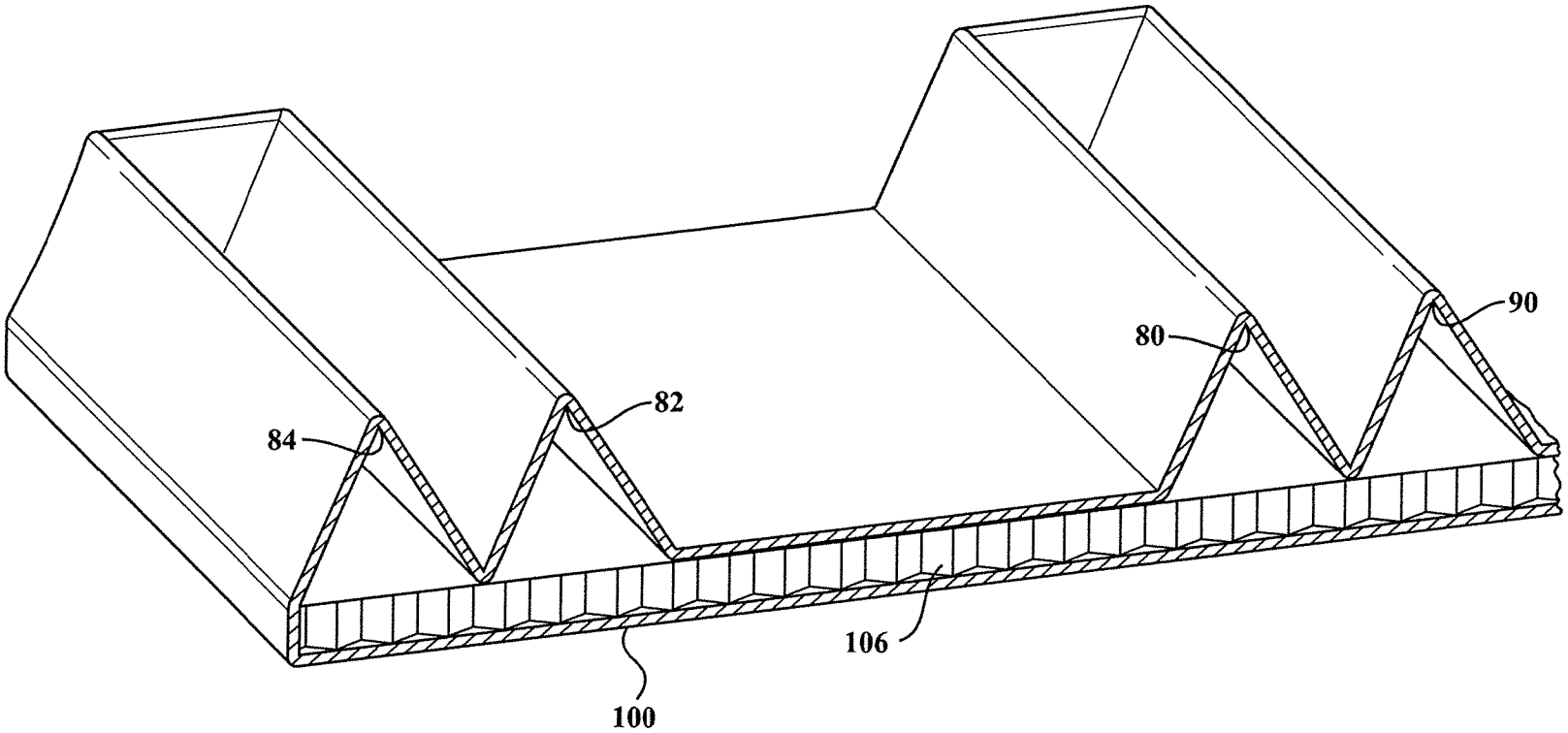
FIG. 11 is a similar illustration to FIG. 10 and depicting a honeycomb or other supporting structure associated with the reinforcing insert which is encapsulated within the folded and three dimensionally constructed one piece pallet body.
Figure 12:
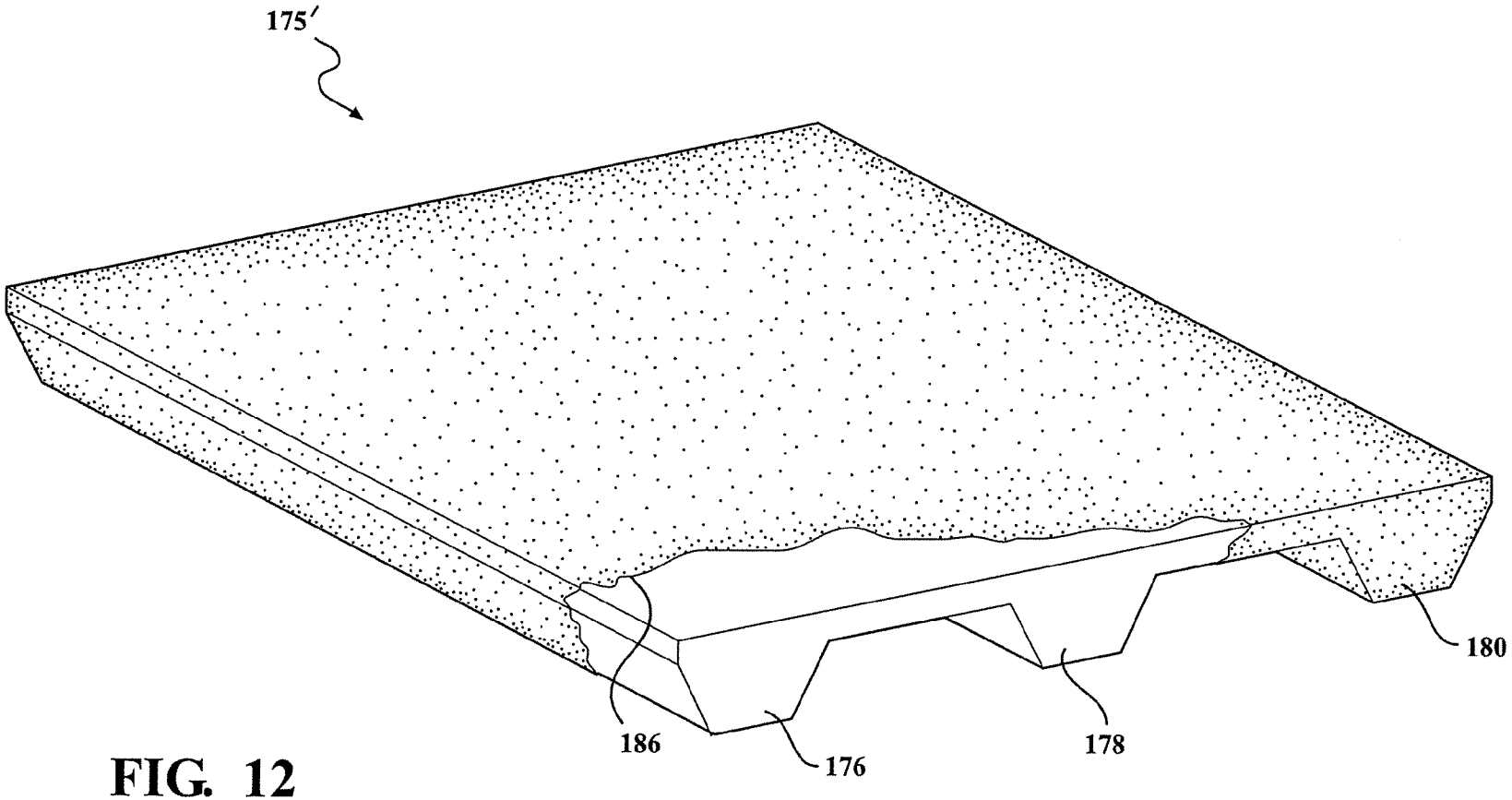
FIG. 12 illustrates a perspective of the pallet in FIG. 9 with an overspray coating of plastic material.

As further shown in FIG. 7, the conveyor station, at 177, feeds the assembled articles 175 in a direction indicated by arrow 179 to a remote spray or coating operation for applying a desirable plastic based sealant (see as shown and described in FIG. 12). The pallet shaped article 175 as again depicted in FIG. 9 includes an upper load supporting surface 181 (corresponding to the central area 100 of the manipulated blank 22" which is wrapped around the reinforcing insert 106 as further shown in FIG. 11), and from which extend the underside support profiles 176, 178 and 180.

While not depicted in separate detail, it is understood that each of the roller knife supported incising station 14 and creasing/bending/forming station 16 can incorporate a suitable arrangement of servo-controlled motors, cylinders and the like for manipulating the various componentry (including the side gripping portions and end pivotal/displaceable elongated arms) in order assemble the pallet (or other suitable) article in the manner described. The operator station 20 can also input variations to the assembly and can interface with various sensors positioned at the individual assembly stations for monitoring any sensed deviations from pre-programmed assembly protocols.

It is also understood that any suitable combination of engaging structure, including modifications to the design of the tabs, slots and other engaging structural indicia formed into the pallet defining blank, may be employed in order to create an integrated and structurally supporting article. Additional components such as hot melt adhesives or the like can be employed in combination with the tab and slot engaging locations to provide further structural integrity to the assembled article.

Figure 9:
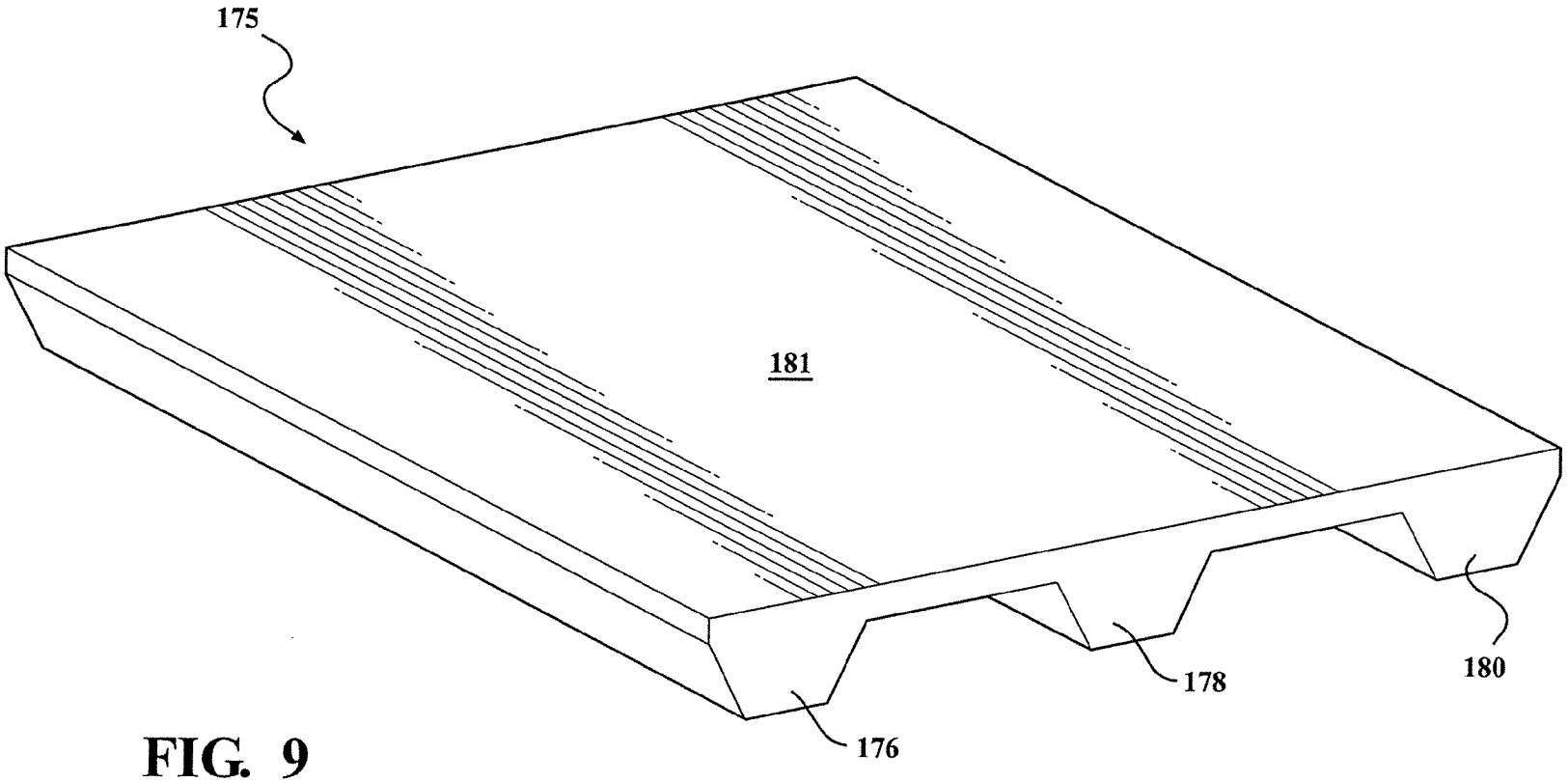
FIG. 9 is a perspective rotated view of a three dimensionally and one piece constructed blank depicted in conveyed fashion upon the removal station of FIG. 7.
Figure 10:
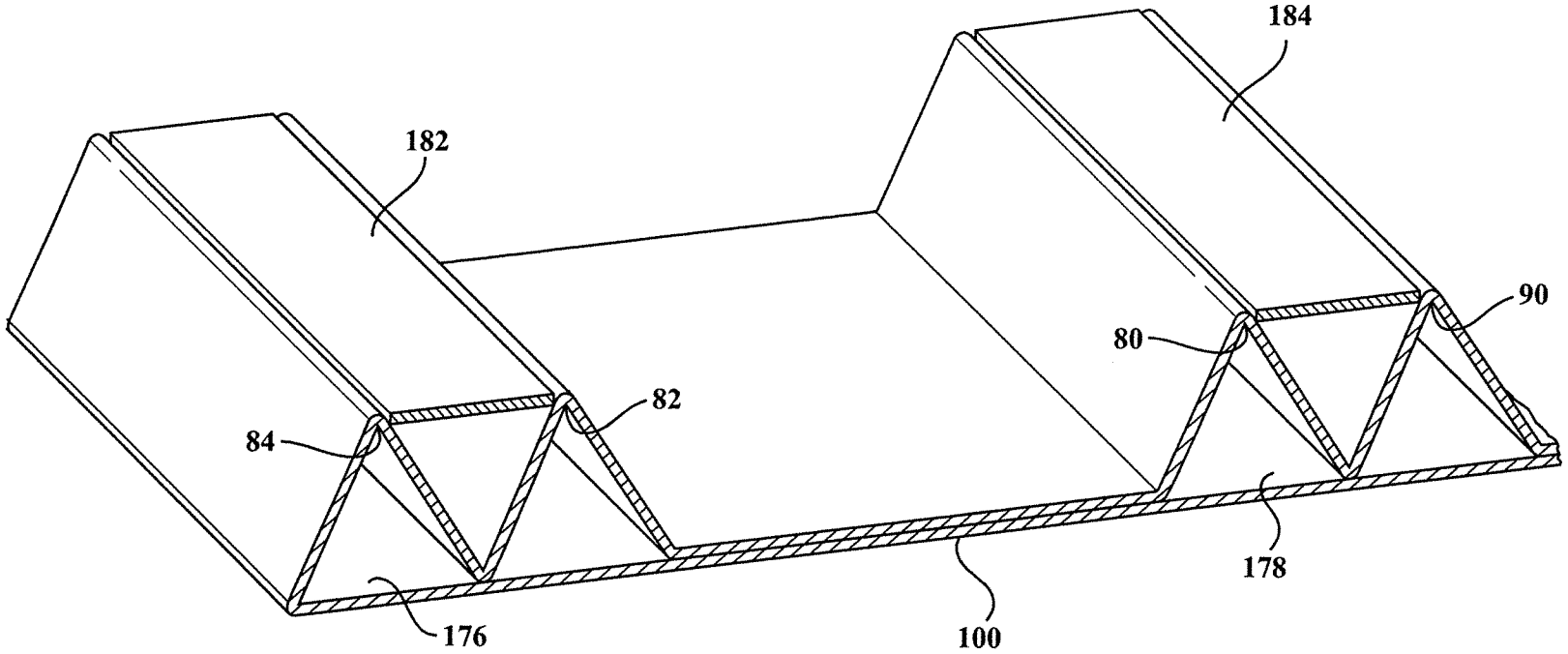
FIG. 10 is an enlarged and partial edge view of a folded edge profile of the pallet with edge covering flaps removed and better depicting the interior beams associated with the underside support profiles and further depicting optional bottom sealing strips for closing off the recessed interior defining underside edges of the support profiles.

FIG. 10 is an enlarged and partial edge view of a folded edge profile of the pallet with edge covering flaps removed and better depicting the interior beams associated with the underside support profiles (represented by underside support locations 176, 178 and 180 in FIGS. 7 and 9) and further depicting optional bottom sealing strips, at 182 and 184 (FIG. 10), for closing off the recessed interior defining underside edges of the support profiles. The strips 182 and 184 can be provided as additional lengths of cardboard material which have been previously sized and which are applied by adhesives or the like to the open underside triangular profile provided by the creased, bent and assembled wings of the cardboard blank (see again crease lines in the modified blank depicted in plan view in FIG. 8). As further previously described, the pallet can be constructed of any sheet stock material not limited to a paper, corrugated paperboard, a modified paper and polymeric composite material and the like.

FIG. 11 is a similar illustration to FIG. 10 and depicting a honeycomb or other supporting structure associated with the reinforcing insert 106, which is encapsulated within the folded and three dimensionally constructed one piece pallet body. Without limitation, the upper surface of the constructed pallet can be sandwiched with any honeycomb or other reinforcing structure up to several inches in thickness, it further being understood that the insert includes but is not necessarily limited to a heavy duty paperboard or other corrugated rigid and load supporting material.

FIG. 12 illustrates a perspective of the pallet in FIG. 9 with an overspray coating of a plastic material 186, applied in any thickness desired, and in order to create a completed pallet assembly 175'. Without limitation, the plastic material can incorporate any fluidic polymer based material, not limited to any type of urethane or other plastic incorporating both settable and environmentally sealing properties such as which is desirable for maintaining long term structural integrity of a paperboard structure associated with the pallet 175. The plastic coating 186 can further include any type of grit or abrading aggregate, this in order to establish a desired texturing or roughening of the exterior surfaces of the pallet, and to assist in supporting cargo supported thereupon.

It is also envisioned that the plastic can be sprayed, roller applied or otherwise coated (such as in a dipping process) to the exterior surfaces of the blank constructed pallet and in order to establish both environmental sealing and structural longevity. To this end, the ability to construct the underside support locations 176, 178 and 180 in the manner shown and as part of the integral one piece construction of the blank (and as opposed to gluing or otherwise adhesively or mechanically securing separate support pieces to the underside of the main support portion of the pallet) provides additional support to the completed pallet and prevent shearing detachment of the underside support in response to any unexpected lateral induced forces (e.g. being struck by the forks of a forklift or in response to being otherwise tilted or contacted in a lateral direction by other pallets or cargo).

Figure 13:
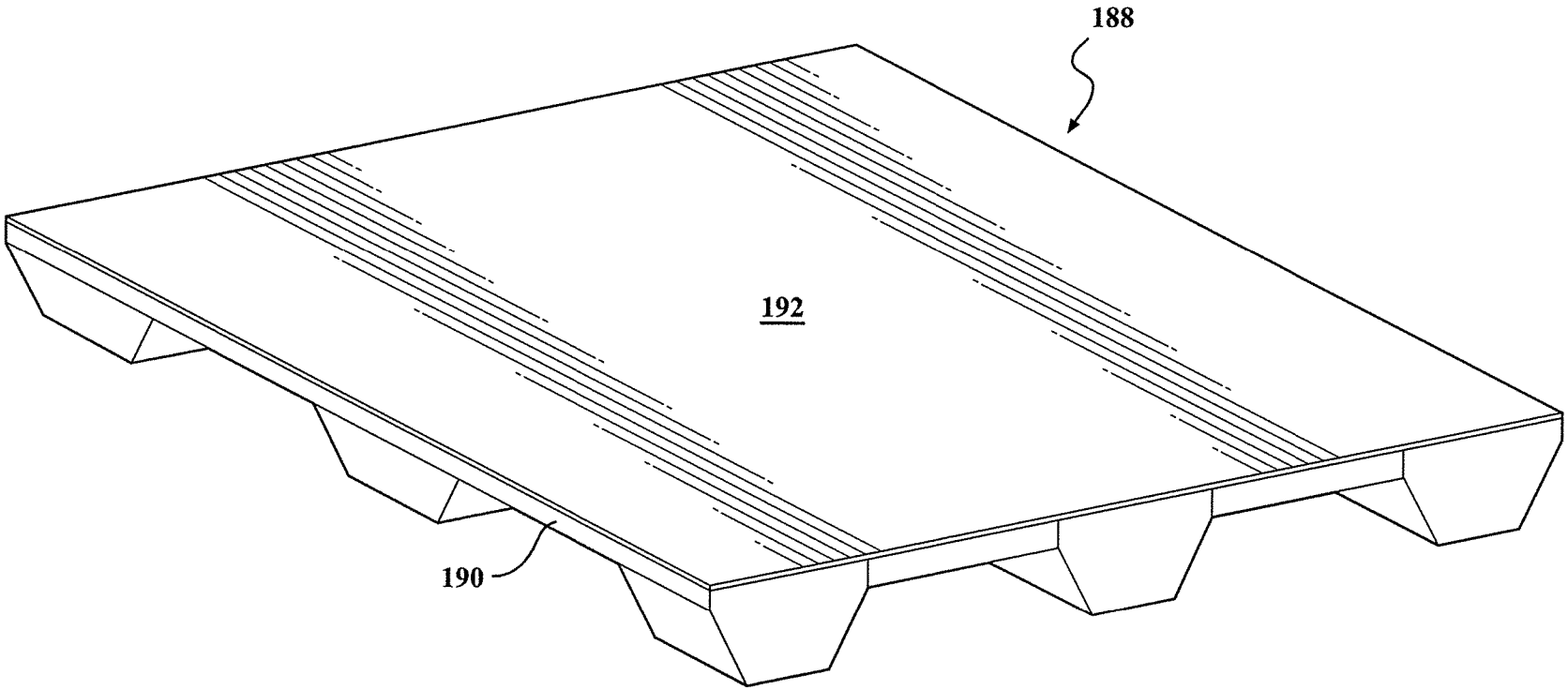
FIG. 13 is a perspective illustration of an alternately constructed pallet including a different pattern of underside supporting profiles.
Figure 14:
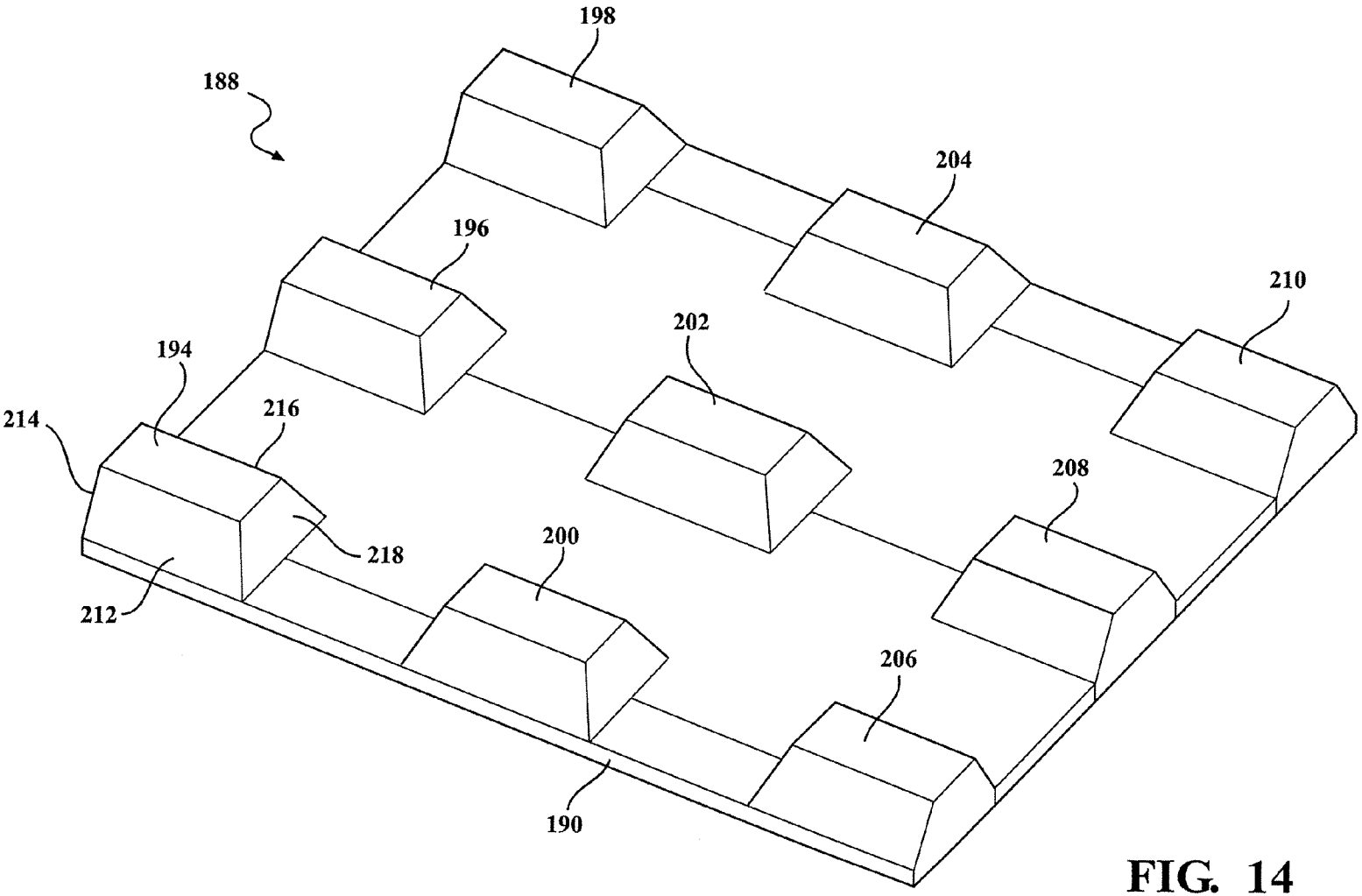
FIG. 14 is a rotated underside perspective of the pallet of FIG. 13 and showing three dimensional profile of the plurality of spaced apart and individually configured underside support profiles.

FIGS. 13 and 14 are upper and rotated underside perspective illustrations, both generally at 188, of an alternately constructed pallet which is capable of being constructed by a similar assembly line process including the steps of feeding blank cardboard sheets upon an incising/scribing machine, following which a multi-stage creasing/bending/forming machine assembles the blank into a three dimensional pallet structure. The pallet 188 is depicted uncoated however it is understood that a suitable spray coating, dipping process or the like can be applied to the pallet in the manner previously described.

As with the previously described pallet construction 175, the variant 188 can exhibit a main deck or support, exhibiting a side thickness 190 and an upper surface 192, and which can be of any thickness and which can also optionally include the pre-placement of the honeycombed or otherwise structurally supporting insert 106. The variant 188 illustrated is further intended to depict the ability of the present assembly and assembly process to be modified, both structurally as well as in terms of operational protocol and method, to any degree necessary in order to produce a differently configured pallet or other structural article made from an initially incised blank material which is subsequently reformed to the completed three dimensional shape. Without elaboration, this can include reconfiguring the various roller knife/incising and bending/assembling operations (including reconfiguration such as the elongated support arms and positioned grippers), and as necessary in order to assemble an incised blank which is understood to be variable from that shown in order to achieve a different three dimensional assembled configuration.

As best shown in the rotated underside of FIG. 14, a different pattern of underside supporting profiles is depicted by a plurality of individual and spaced apart locations 194, 196, 198, 200, 202, 204, 206, 208 and 210 which are arranged in spatially separated fashion along the underside surface of the assembled pallet in the manner shown (in one non-limiting fashion these permit the inserting of lift forks for permitting transfer of the pallet and any materials supported thereupon).

The individual support profiles, referring by example to profile 194, can exhibit any pattern of straight vertical or, as shown, angled walls 212, 214, 216 and 218, with the underside either being open in a manner similar to as shown in FIG. 11 or, as also shown in FIG. 10, closed by the addition of individual strips of material which can be adhered or otherwise applied around the bottom facing inner perimeter associated with each individually constructed support profile. As also previously described, the material construction of the sheet stock blank material can include any cardboard, composite paperboard or other composite material including polymeric or other components to further provide structural integrity to the assembly.

The present invention also most broadly recites a method for constructing a three dimensional article, which most broadly includes the steps of feeding a sheet material in blank form, incising the blank in order to create a desired cutout pattern; and successively creasing and folding the incised blank into an assembled article. Additional steps include configuring each of tabs and slots in proximate side extending edges of the incised blank.

Other steps include the creasing of the blank further including forming first and second wings with multiple fold lines which extend from a central planar portion of the blank. The step of folding the blank into an assembled article further includes inserting the tabs into the slots.

Additional method steps include placing a reinforcing planar shaped insert upon the central blank portion prior to folding the wings into a three dimensional shaped configuration and conveying the assembled article to a separate coating operation for applying a plasticized layer over the article. Other steps include applying bottom sealing strips for sealing recessed interior defining underside edge profiles associated with a plurality of underside supports created in the assembled article, and incorporating a reinforcing honeycomb pattern into the planar shaped insert.

Having described my invention, other and additional preferred embodiments will become apparent to those skilled in the art to which it pertains, and without deviating from the scope of the appended claims.

I claim:

1. An assembly for constructing a three dimensional article, comprising:

a first station for feeding a sheet shaped blank;

a second station for receiving and incising the blank from said first station, a support surface of said second station exhibiting first and second length edge extending incising patterns over which the blank is supported;

a drum shaped roller knife supported above said surface of said second station, said roller knife being traversed in pressing contact with the blank, between first and second ends of the blank, in order to remove portions of material from the blank corresponding to the formation of tabs and slots along opposite side edges of the blank;

a third station having a further support surface for receiving the blank from said second station, a plurality of widthwise extending and elongated rods being supported within said third station in communication with the further support surface and being manipulated to form a plurality of creases in the blank;

said third station further having first and second pluralities of bending arms supported in crosswise directions relative to said elongated rods, additional pluralities of forming guides positioned at side locations of the blank in alignment with the tabs, said bending arms being manipulated to fold inwardly sections of the blank which are proximate the first and second ends and, in communication with upward displacement of said bending arms, causing the tabs and slots to be interengaged during formation of the three dimensional article; and an operator station for controlling each of said first, second and third stations.

2. The assembly as described in claim 1, further comprising a conveyor for removing the assembled article from the third station and transferring to a plastic coating operation.

3. The assembly as described in claim 1, said further comprising additional incising patterns formed into said drum shaped roller knife.

4. The assembly as described in claim 3, further comprising a pair of pedestals rotatably supporting said drum knife above said support surface, said pedestals being traversed along guides in said second station as said roller knife is rolled across and over the blank, said additional incising patterns on said roller knife synchronized with said incising patterns of said support surface of said second station.

5. The assembly as described in claim 1, said plurality of elongated rods of said third station further comprising first and second sub-pluralities of elongated rods which are channeled to extend through an equal number of base components secured atop a perimeter extending about said further support surface such that said elongated rods extend over and across a pair of spaced apart recessed regions in said further support surface upon which the blank is positioned.

6. The assembly as described in claim 5, further comprising each of said recessed regions further exhibiting a plurality of inter-angularly configured surfaces.

7. The assembly as described in claim 5, each of said sub-pluralities of elongated rods further comprising an underside projecting and fold-line forming blade edge creasing a width extending surface of the blank.

8. The assembly as described in claim 5, further comprising a rectangular shaped reinforced insert placed upon a central surface area of the blank between which are inwardly folded the first and second end sections, the three dimensional article further defining an assembled pallet.

9. The assembly as described in claim 5, said further comprising said bending arms configured such that they are pivotally secured at proximal ends to interior locations of said further support surface and further so that they are mechanically controlled to ascend through length extending and spaced apart slots formed in said recessed regions.

10. The assembly as described in claim 9, said pluralities of opposite end extending and bending arms each further comprising length displaceable gripping portions both pivotally and displaceably associated with each of said elongated rods and which, collectively, configure a plurality of underside support profiles formed from a previously pair of deformed wings of the blank which are hingedly associated with a reinforced central portion of the blank.

11. An assembly for constructing a three dimensional article, comprising:

a first station for feeding a sheet shaped blank;

a second station for receiving the blank from said first station;

a drum shaped roller knife supported above a support surface of said second station, said roller knife being traversed in pressing contact with the blank, between first and second ends of the blank, a pair of length extending incising patterns defined between said roller knife and said support surface, between which the blank is supported, and remove portions of material from opposite sides of the blank corresponding to the formation of tabs and slots in the blank;

a third station having a further support surface for receiving the blank from said second station, a plurality of widthwise extending and elongated rods being supported within said third station in communication with the further support surface and being manipulated to form a plurality of creases in the blank;

said third station further having first and second pluralities of bending arms supported in crosswise directions relative to said elongated rods, additional pluralities of forming guides positioned at side locations of the blank in alignment with the tabs, said bending arms being manipulated to fold inwardly sections of the blank which are proximate the first and second ends and, in communication with upward displacement of said bending arms, causing the tabs and slots to be interengaged during formation of the three dimensional article; and an operator station for controlling each of said first, second and third stations.

12. An assembly for constructing a three dimensional pallet article, comprising:

a first station for feeding a sheet shaped blank;

a second station for receiving and incising the blank from said first station, a support surface of said second station exhibiting first and second length edge extending incising patterns over which the blank is supported;

a roller knife supported above said support surface of said second station, said roller knife being traversed in pressing contact with the blank, between first and second ends of the blank, and in order to remove portions of material from the blank corresponding to the formation of tabs and slots along opposite side edges of the blank;

a third station having a further support surface for receiving the blank from said second station, first and second sub-pluralities of widthwise extending and elongated rods being supported within said third station in communication with the further support surface and being manipulated to form a plurality of creases in the blank, each of said sub-pluralities of elongated rods further comprising an underside projecting and fold-line forming blade edge creasing a width extending surface of the blank;

said third station further having first and second pluralities of bending arms supported in crosswise directions relative to said elongated rods, additional pluralities of forming guides positioned at side locations of the blank in alignment with the tabs;

a rectangular shaped reinforced insert placed upon a central surface area of the blank in alignment with the forming guides;

said bending arms being manipulated to fold inwardly sections of the blank which are proximate the first and second ends over said reinforced insert and, in communication with upward displacement of said bending arms, causing the tabs and slots to be interengaged during formation of the three dimensional pallet article; and an operator station for controlling each of said first, second and third stations.

* * * * *